US006457254B2

(12) United States Patent
Sahm

(10) Patent No.: US 6,457,254 B2
(45) Date of Patent: Oct. 1, 2002

(54) MULTIFUNCTIONAL APPARATUS FOR THE TREATMENT OF HAIR OF THE HEAD OF HUMANS

(76) Inventor: Jurgene E. Sahm, Friedlisbergstrasse 29, CH-8965 Berikon (CH)

( * ) Notice: Subject to any disclaimer, the term of this patent is extended or adjusted under 35 U.S.C. 154(b) by 0 days.

(21) Appl. No.: 09/838,710

(22) Filed: Apr. 19, 2001

(30) Foreign Application Priority Data

May 3, 2000 (CH) ..... 870/00

(51) Int. Cl.[7] ..... A45D 20/00

(52) U.S. Cl. ..... 34/96; 34/97; 34/98; 34/99; 132/212; 392/380; 392/382

(58) Field of Search ..... 34/96, 97, 98, 34/99, 101, 283; 132/212; 392/379, 380, 382

(56) References Cited

U.S. PATENT DOCUMENTS

| | | | | |
|---|---|---|---|---|
| 1,560,894 A | | 11/1925 | Blum et al. | |
| 3,645,007 A | * | 2/1972 | Scott | 34/60 |
| 3,727,322 A | | 4/1973 | Walter et al. | 34/99 |
| 3,814,111 A | * | 6/1974 | Doyle et al. | 132/272 |
| 4,021,930 A | * | 5/1977 | Churas et al. | 132/212 |
| 4,256,127 A | * | 3/1981 | Tsujimoto et al. | 132/212 |
| 4,352,248 A | * | 10/1982 | Kobayashi | 261/142 |
| 4,721,122 A | | 1/1988 | Sahm | 132/9 |
| 6,024,100 A | * | 2/2000 | Fukuyama | 132/200 |

FOREIGN PATENT DOCUMENTS

| | | |
|---|---|---|
| FR | 1459938 | 2/1967 |
| GB | 473633 | 10/1937 |

* cited by examiner

*Primary Examiner*—Jiping Lu
(74) *Attorney, Agent, or Firm*—Ladas & Parry

(57) ABSTRACT

A supporting column part supports a housing in which an apparatus for producing hot air and a further apparatus for producing steam are located. A jib is pivotally mounted to the housing. A hot air pipe extends from the apparatus for producing hot air through the jib to a treatment head part. A dispensing head is mounted for rotation on the hot air pipe. This dispensing head is connected at one side to dispensing hoses adapted to be coupled to hair curlers. Diffusor-like arranged exit holes are located at the opposite side. A steam pipe extends from the apparatus for producing steam obliquely into the hot air pipe so that an ejector is formed. The jib part has a through shaped receiving container portion and a cover lid portion pivotally mounted to the receiving container portion. In order to store the dispensing hoses the coverlid portion is rotated upwards and the dispensing hoses are placed into the receiving container portion.

14 Claims, 8 Drawing Sheets

MULTIFUNCTIONAL APPARATUS FOR THE TREATMENT OF HAIR OF THE HEAD OF HUMANS

CROSS REFERENCE TO RELATED APPLICATIONS

This application claims the priority of Swiss Patent application No. 870/00, filed May 3, 2000, the disclosure of which is incorporated herein by reference in its entirety.

BACKGROUND OF THE INVENTION

1. Field of the Invention

The present invention relates to a multifunctional apparatus for the treatment of hair of the head of humans, the apparatus having a supporting column part and a jib part which ends at a treatment head part.

2. Description of the Related Art

In order to treat the hair of the head, such as a forming of permanent waves, a coloring, drying, etc. a hairdresser need various apparatuses and such a large number of apparatuses occupy a lot of space of a hairdresser's shop. Recent developments show that hairdresser's shops get smaller which means that less floor space is available for a placing and storing the various apparatuses. Furthermore, until now a hairdresser had been able to use only one single apparatus for a respective specific treatment of the hair which apparatus is of a design which is structurally complete in itself, during which treatment all other apparatus stood useless around in the shop.

BRIEF SUMMARY OF THE INVENTION

Hence, it is a general object of the invention to provide a multifunctional apparatus for the treatment of hair of the head of a human in which a plurality of different part-apparatuses for respective different treatments are united in one and the same apparatus.

A further object of the invention is to provide a multifunctional apparatus for the treatment of hair of the head of a human, which comprises a housing which is mounted to the supporting column part; at least one apparatus for producing hot air; at least one further apparatus for producing steam; which at least one apparatus for producing hot air and which at least one further apparatus for producing steam are located inside of mentioned housing; a jib part which is hingedly mounted to the housing; which treatment head part includes a dispenser head which communicates with the at least one and the at least one further apparatus located inside mentioned housing; which dispenser head is supported for rotation between two end positions and includes at one side a diffuser portion with exit holes for at least one medium supplied from the at least one and the at least one further apparatus; and includes at a further side located opposite of the first named side a plurality of pipe stubs which are coupled to dispensing hoses and communicate with at least one of mentioned at least one and mentioned at least one further apparatuses; which dispensing hoses are adapted to be coupled to hair curlers; whereby in one of the end positions of the dispenser head the exit holes and in the other one of the end positions of the dispenser head the pipe stubs communicate with at least one of mentioned apparatuses located inside of the housing.

The advantages gained by the invention are seen substantially in the disclosed apparatus occupates much less space in a hairdresser's shop as occupied until now by the conventional apparatuses, and that during one specific treatment of hair no apparatuses for other specific treatments which are not used stand or lie around without any use.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
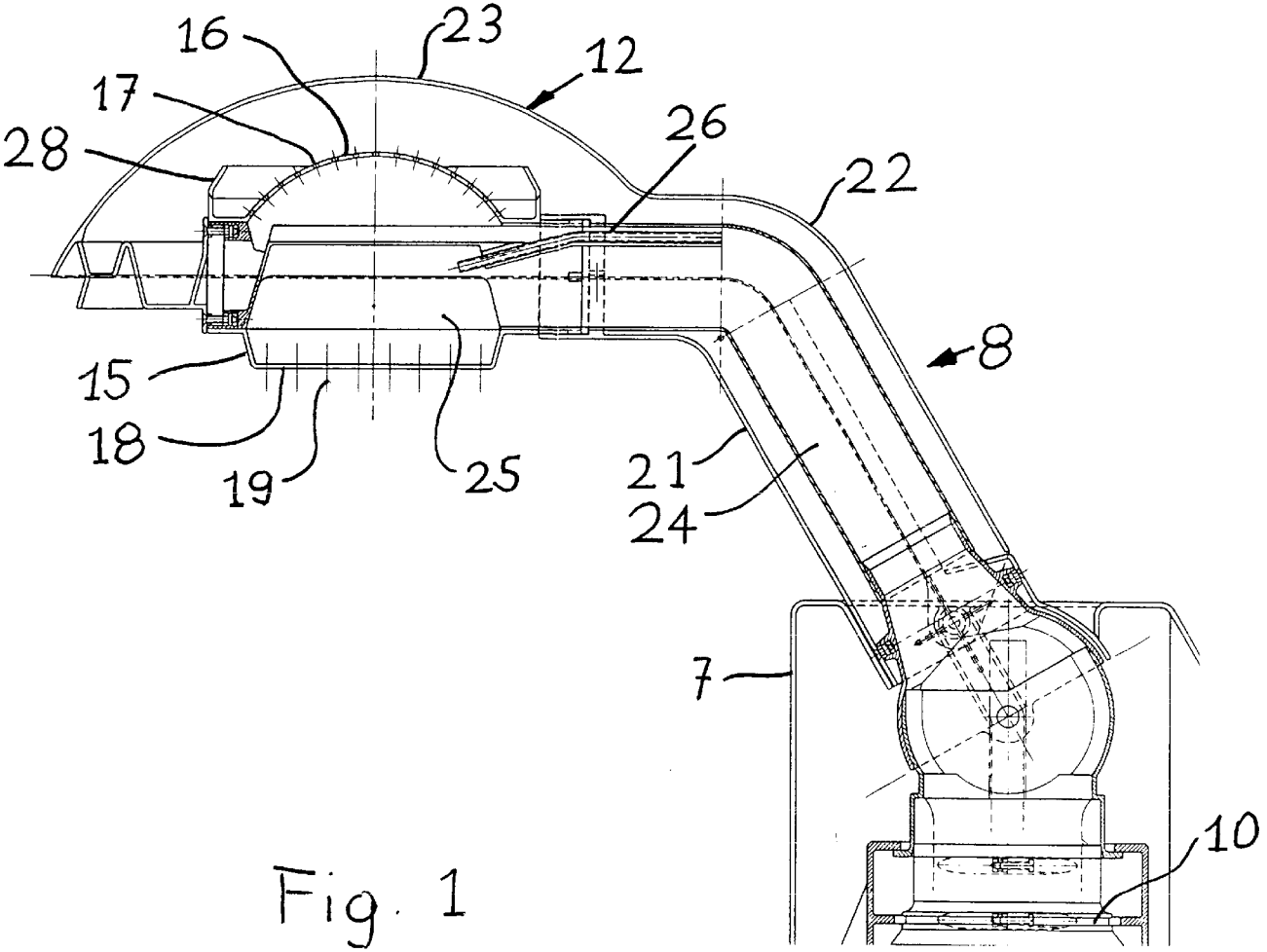
FIG. 1 illustrates a view, partly in section, of a jib part with a treatment head part, which jib part his hingendly mounted to a housing.

The multifunctional apparatus has a supporting column part 1. This supporting column part 1 is mounted onto a bottom frame 2 with rollers, of which bottom frame 2 a supporting arm 3 and two rollers 4, 5 are illustrated, via which the apparatus rests on the floor 6 of for instance a hairdresser's shop. In total, two such supporting arms and four rollers are present. The horizontal distance between the two supporting arms is, thereby, dimensioned large enough so that a chair for a person of which the hair is getting treated may be placed between the two supporting arms.

Figure 2:
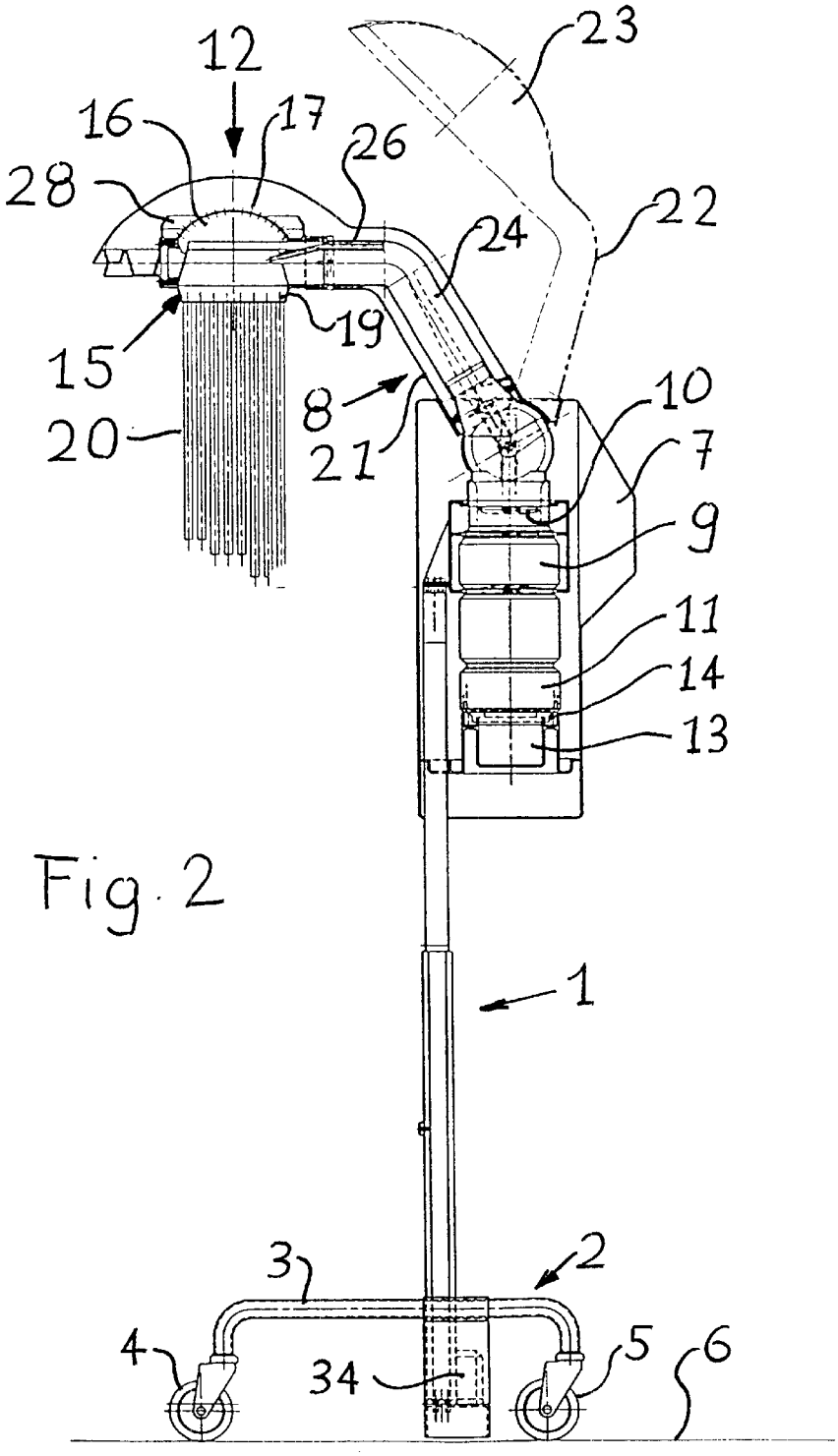
FIG. 2 illustrates a view of an apparatus according to the present invention in a first configuration.
Figure 3:
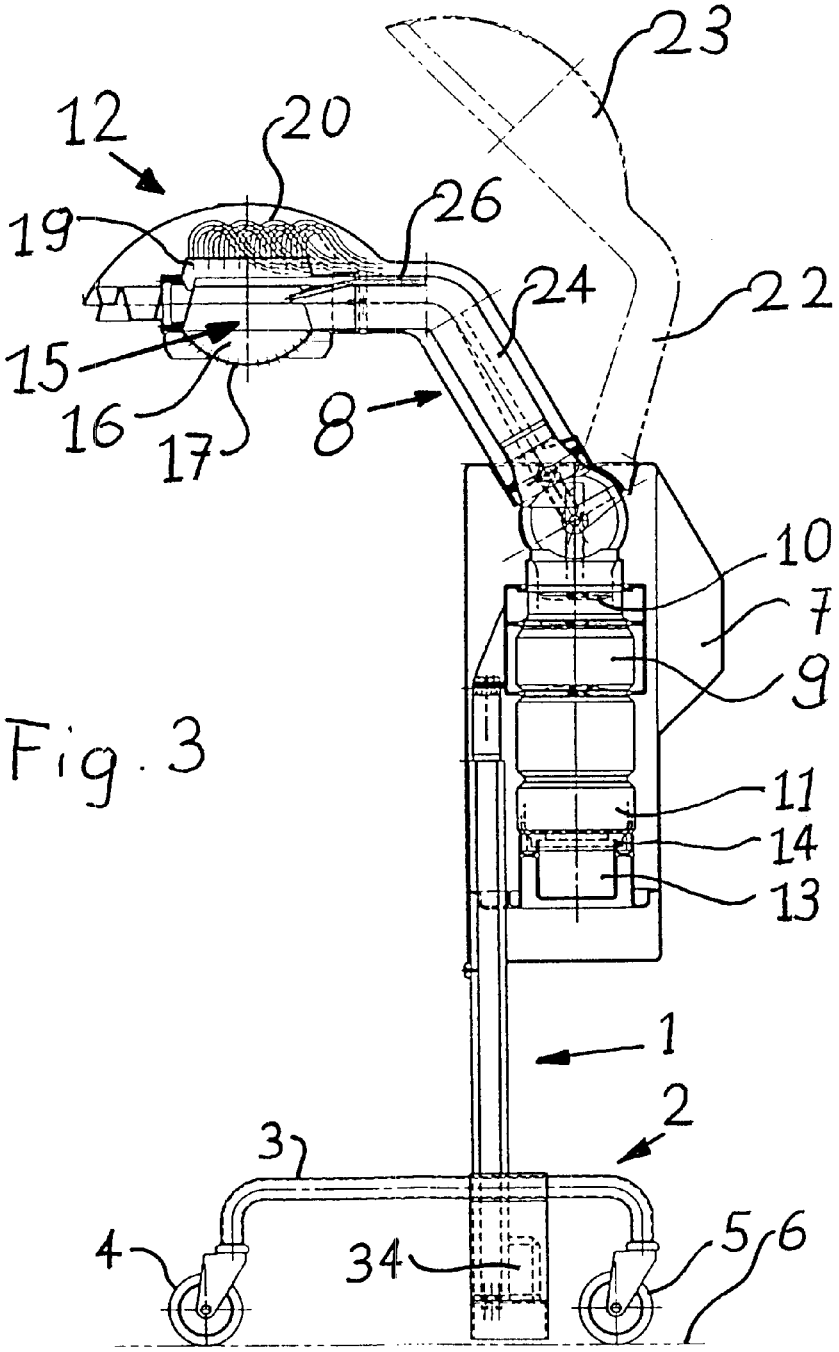
FIG. 3 illustrates the apparatus of FIG. 2 in a second configuration.

When comparing FIG. 2 and FIG. 3 it becomes obvious that the length of the supporting column part 1 may be adjusted so that the height position of the structures supported by the supporting column part 1 can be adjusted.

A housing 7 is mounted to the supporting column part 1. A jib part 8 is pivotally mounted to this housing 7, which jib part 8 ends at a treatment head part 12.

An apparatus 9 for producing hot air is located inside of the housing 7. Such apparatuses are generally known and, thus, a detailed description of this apparatus 9 is not necessary. It is merely to be noted that the feeding of the hot air is achieved by a turbine wheel 10. With respect to the expression hot air it is to be distinctly understood that temperature of the hair treatment air is as high or as low, respectively as is conventional for drying or treating hair, thus the expression warm air would also be applicable.

An apparatus 11 for producing steam is also located inside of the housing 7. This apparatus 11 for producing steam includes a water tank 13 on which there is mounted a ultrasonic atomizer 14 of a well known conventional design. A ultrasonic atomizer included a membrane, which oscillates at a high frequency, so that due to the high frequency oscillations an evaporating of the water is achieved.

The treatment head part 12 which is located at the free end of the jib part 8 which is pivotally mounted to the housing 7, includes a dispensing head 15 which communicates generally with the two above mentioned apparatuses 9, 11.

This treatment head 15 is supported for rotation between two end positions such as will be described further below.

The treatment head 15 has at one side, identified by the reference numeral 16, a diffuser portion having exit holes 17 for a respective hair treatment medium coming from at least one of the apparatuses 9, 11.

At a further side 18 which is located opposite of the above mentioned side 16, the treatment head has a number of pipe stubs 19 which are illustrated in the FIGS. 1–4 in a simplified manner by short lines. These pipe stubs 19 are mounted to dispensing hoses 20 for a respective medium coming from at least one of the apparatuses 9, 11. These dispensing hoses 20 are designed and adapted for a coupling to for instance aerated hair curlers which are generally known and thus must not be described in detail.

The jib part 8 is of a bi-partite construction. It is specifically designed for the receipt and storing of the dispensing hoses 20 when these hoses are not in use.

To this end the jib part 8 includes a lower, through shaped receiving container portion 21 (see also FIG. 8) which is pivotally mounted to the housing 7. A cover lid portion 22 carries at its free end a hood part 23. The cover lid portion 22 can be pivoted between an open position and a closed position such as illustrated in the drawings, and the hood part 23 overlies and covers in its closed position the dispensing head 15.

A hot or warm, respective air pipe 24 extends from the apparatus for producing hot air, which pipe 24 is located inside of the jib part 8 and ends at the treatment head part 12, so that a communication with the dispensing head 15 is established.

This dispensing head 15 is now supported for rotation on this hot air pipe 24. The hot air pipe 24 comprises, furthermore, a lower exit opening 25 at the area of the dispensing head 15.

The end of the hot air pipe 24 is closed off and the end areas of the dispensing head 15 are sealed against the hot air pipe 24.

Figure 4:
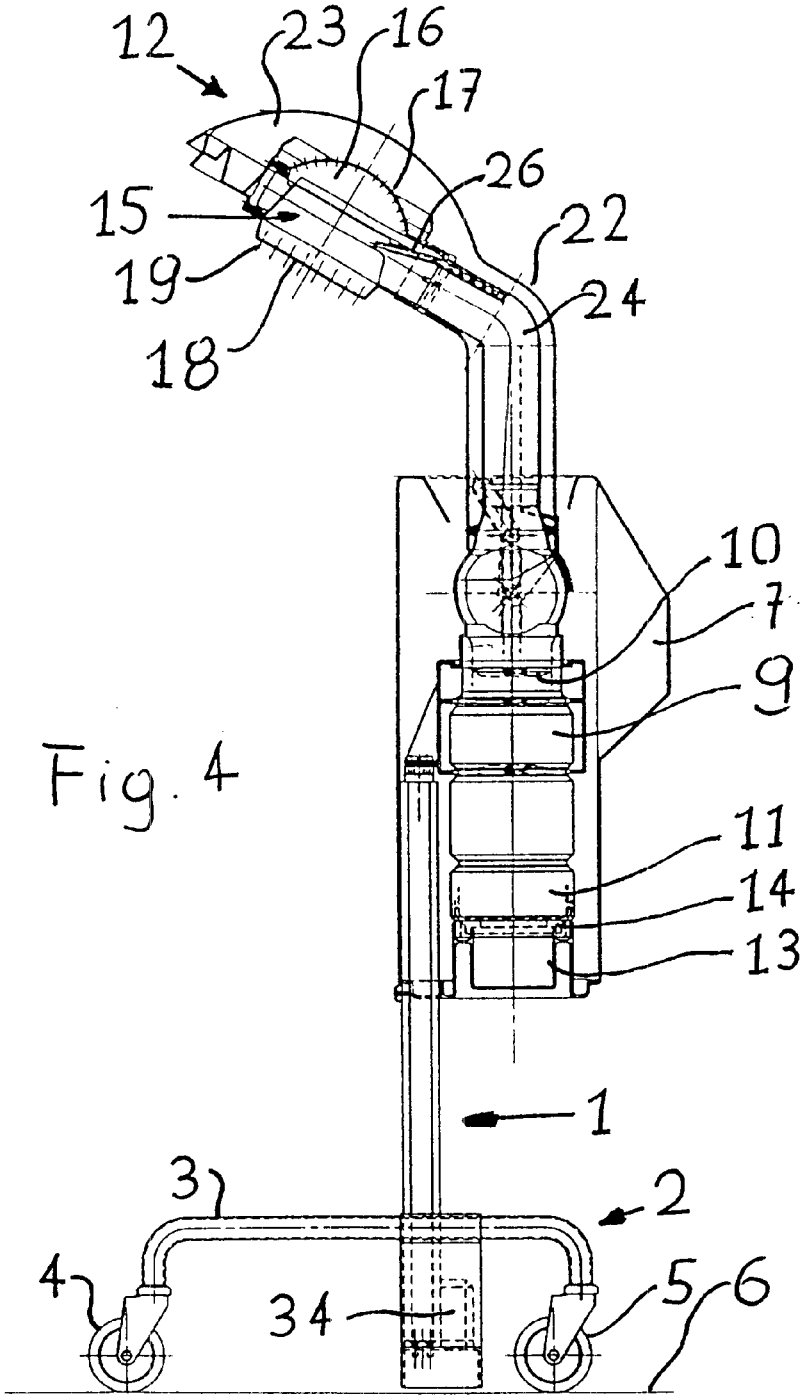
FIG. 4 illustrates the apparatus of FIG. 2 in which the jib is in a state rotated upwards.

If now the dispensing head 15 which is supported for rotation on the hot air pipe 24 is rocated into the end position which is illustrated in FIGS. 1, 2 and 4, the pipe stub 19 and correspondingly the dispensing hose 20 communicate with the apparatus 9 for producing hot air, so that hair curlers which are mounted to the dispensing hoses 20 and accordingly the hair which is wound on the hair curlers can be aerated. The communication to the side 16 of the dispensing head 15, which includes the exit holes 17, is, thereby, blocked.

If the dispensing head 15 is rotated into the position illustrated in FIG. 3, the exit holes 17 will communicate with the apparatus 9 for producing hot air, so that an aeration of the entire head of a respective person by hot air can be achieved, whereto it is to be noted that obviously the temperature of the hot air can be controlled.

If the dispensing head 15 is in this described position, the dispensing hoses 20 can be stored.

Figure 8:
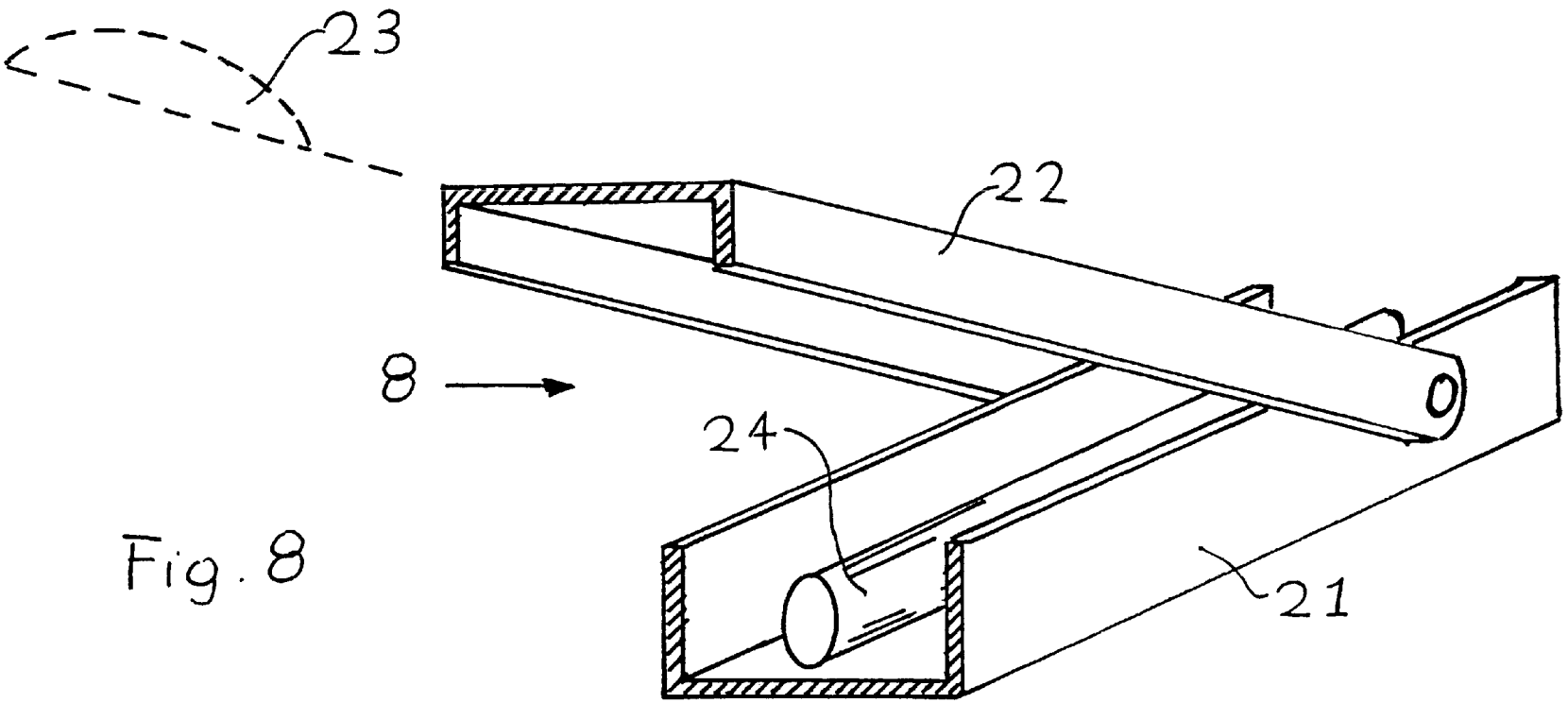
FIG. 8 illustrates schematically the bi-partite jib part in an opened state.

FIG. 8 illustrates on a somewhat simplified basis a portion of the jib part 8. It includes a lower portion, the through shaped receiving container portion 21 which is hingedly mounted to the housing 7. The hot air pipe 24 on which the dispensing head 15 is rotably mounted extends inside of this receiving container portion 21. The cover lid portion 22 which is mounted to the head part 23 and which also forms a part of the jib part 8 is pivotally mounted to the receiving container portion 21.

It shall now be assumed that the dispensing head 15 is in the position illustrated in FIG. 1, in which position the downwards facing pipe stubs 19 with the dispensing hoses which are coupled to hair curlers are in operation.

Now, the operating of the pipe stubs 19 shall be terminated and be moved to the side 16 of the dispensing head 15 and the exit holes 17 taken into operation.

To this end the supporting column part 1 is vertically extended so that it is in the position as illustrated in FIG. 2, compare hereto FIGS. 3 and 4.

The coverlid portion 22 with the hood part 23 is rotated upwards. This position is illustrated in FIG. 2 by broken lines. Thereafter, the dispensing head 15, after the supporting column part 1 has again be vertically shortened, is rotated around the hot air pipe 24 in the position according to FIG. 3.

Figure 7:
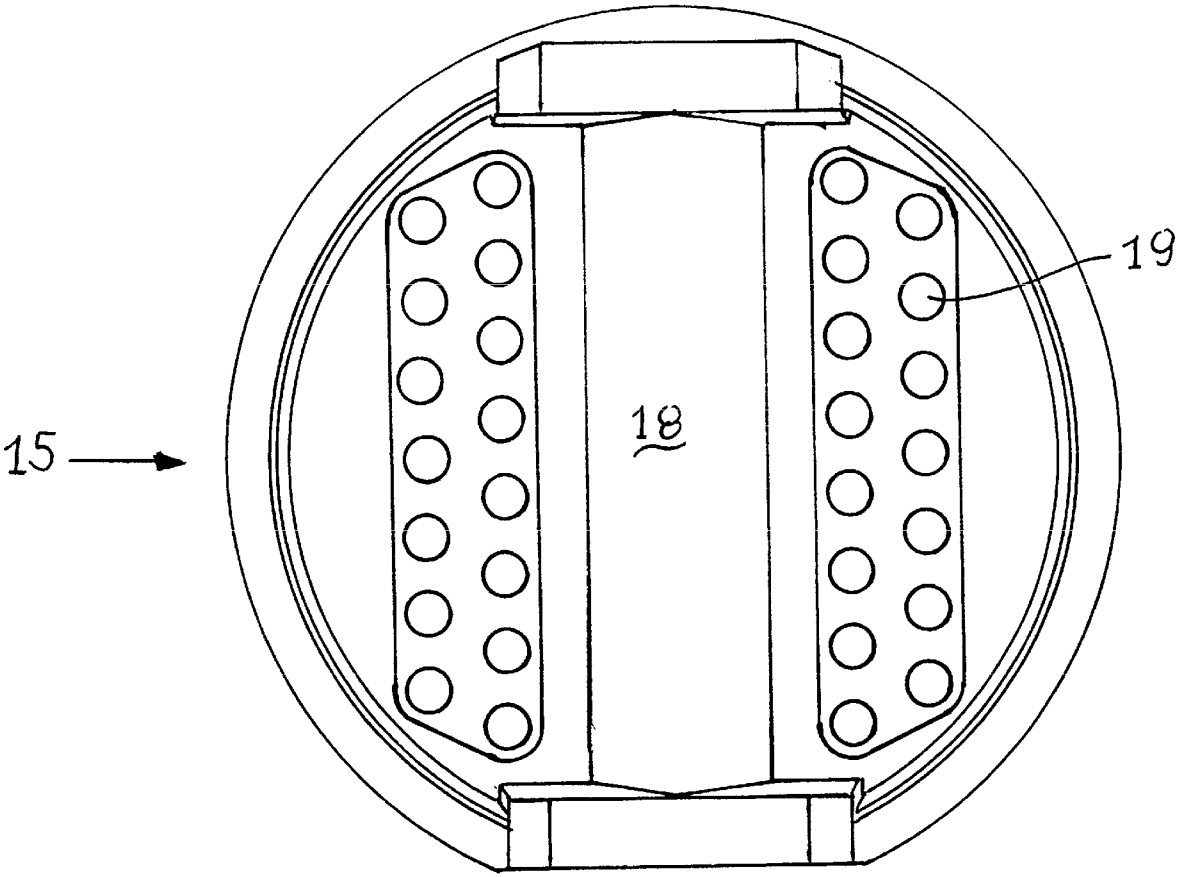
FIG. 7 is a view of the side of the dispensing head which has the connection for hoses.

From FIG. 7, which illustrates a view of the side 18 of the dispensing head 19 having the pipe stubs 19, it becomes obvious that the pipe stubs 19 are arranged in two separate groups.

The dispensing hoses 20 may now be folded back so that they come to lie in the through shaped receiving container portion 21. Because these dispensing hoses 20 are arranged in two groups which are separated from each other as shown in FIG. 7, they can be placed in the through shaped receiving container portion 21 on both sides of the hot air pipe 24, such as illustrated in FIG. 8.

Attention is now once more drawn to FIG. 1. An apparatus 9 for producing hot air and an apparatus 11 for producing steam are located in the housing 7. The hot air is fed by the turbine wheel 10 into the hot air pipe 24.

This apparatus 11 for producing steam comprises an ultrasonic atomizer with a vibrating membrane. Such apparatuses are conventional and generally known in the art.

A steam pipe 26 extends from the apparatus 11 for producing steam to the treatment head part 12. It is specifically shown in FIG. 1 that this steam pipes 26 projects at an area inside of the dispensing head 15 obliquely into the hot air pipe 24. Thus, an ejector is formed in which the hot air, which is fed by the turbine wheel 10, is the driving medium for the steam. This means that the steam is entrained by the hot air and is accordingly fed by the hot air into the dispensing head 15.

The apparatus 11 for producing steam includes a water tank 13 in which the ultrasonic atomizer 14 is located. Various additives for treatment of hair may be added into the water tank 13. It is for instance possible to add to the water in the water tank 13 a product which neutralizes the odour of a permanent wave agent.

Thus this product is in the water in the water tank 13. In operation the water including this product is evaporated and flows as a cold steam into the treatment head part 12 because the steam is entrained in the ejector by the air. The dispensing head 15 is in the position in which the exit holes 17 at the side 16 face the head of the person of which the hair is treated. Thus, an air shower is produced, so that the mentioned product flows onto the hair which previously has been treated by a permanent wave agent, so that a neutralizing of the odour of the permanent wave agent takes place.

Figure 5:
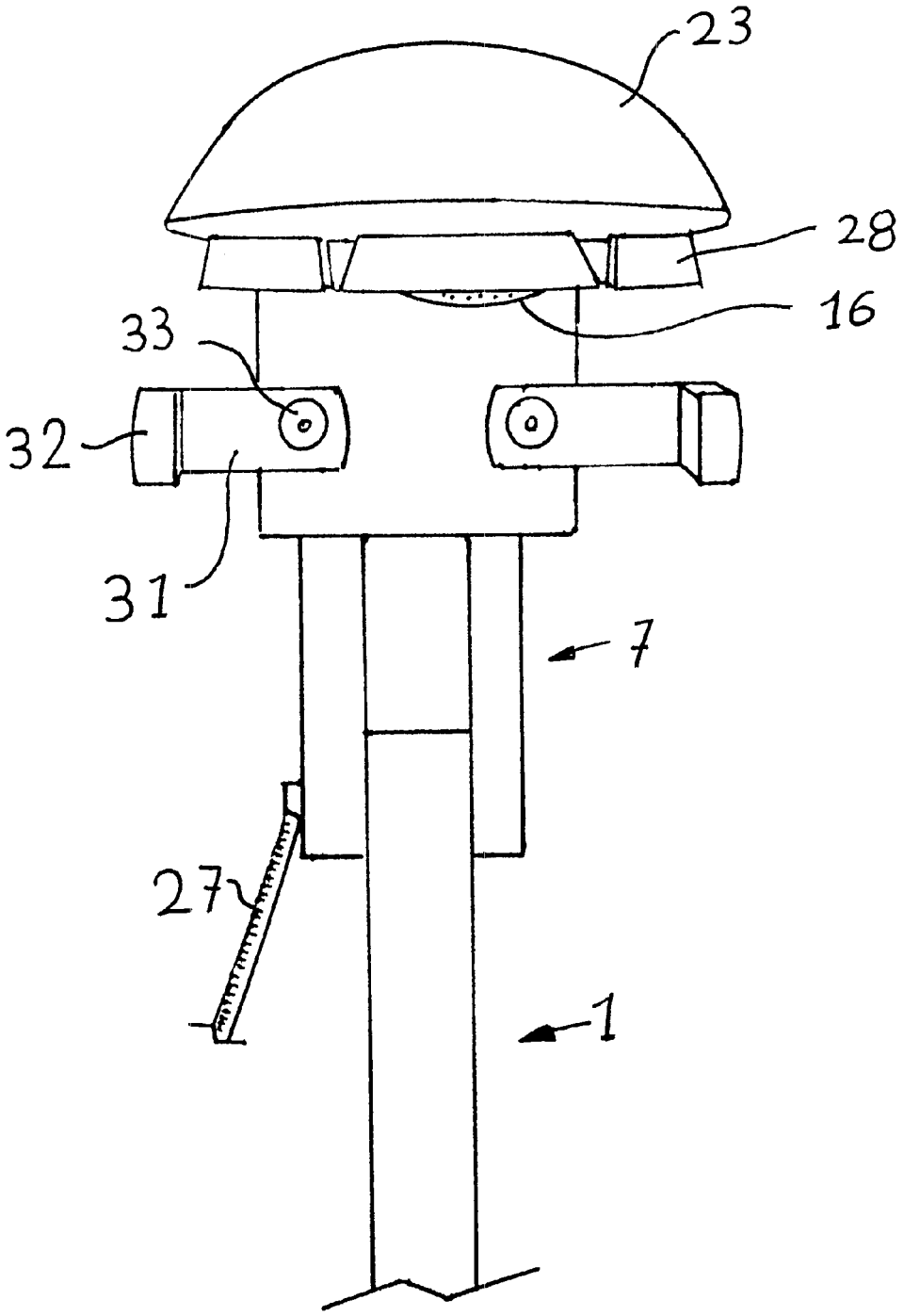
FIG. 5 is a somewhat schematic front view of the apparatus of the present invention in a working position.

The apparatus 9 for producing hot air is equipped with an additional hot air hose 27, see FIG. 5. An aerated hairbrush of a conventional design may be coupled to this additional hot air hose 27 which hairbrush may be used separately.

The dispensing head 15 is, furthermore, surrounded by an annular supporting part 28, which is firmly mounted to the dispensing head 15.

Figure 6:
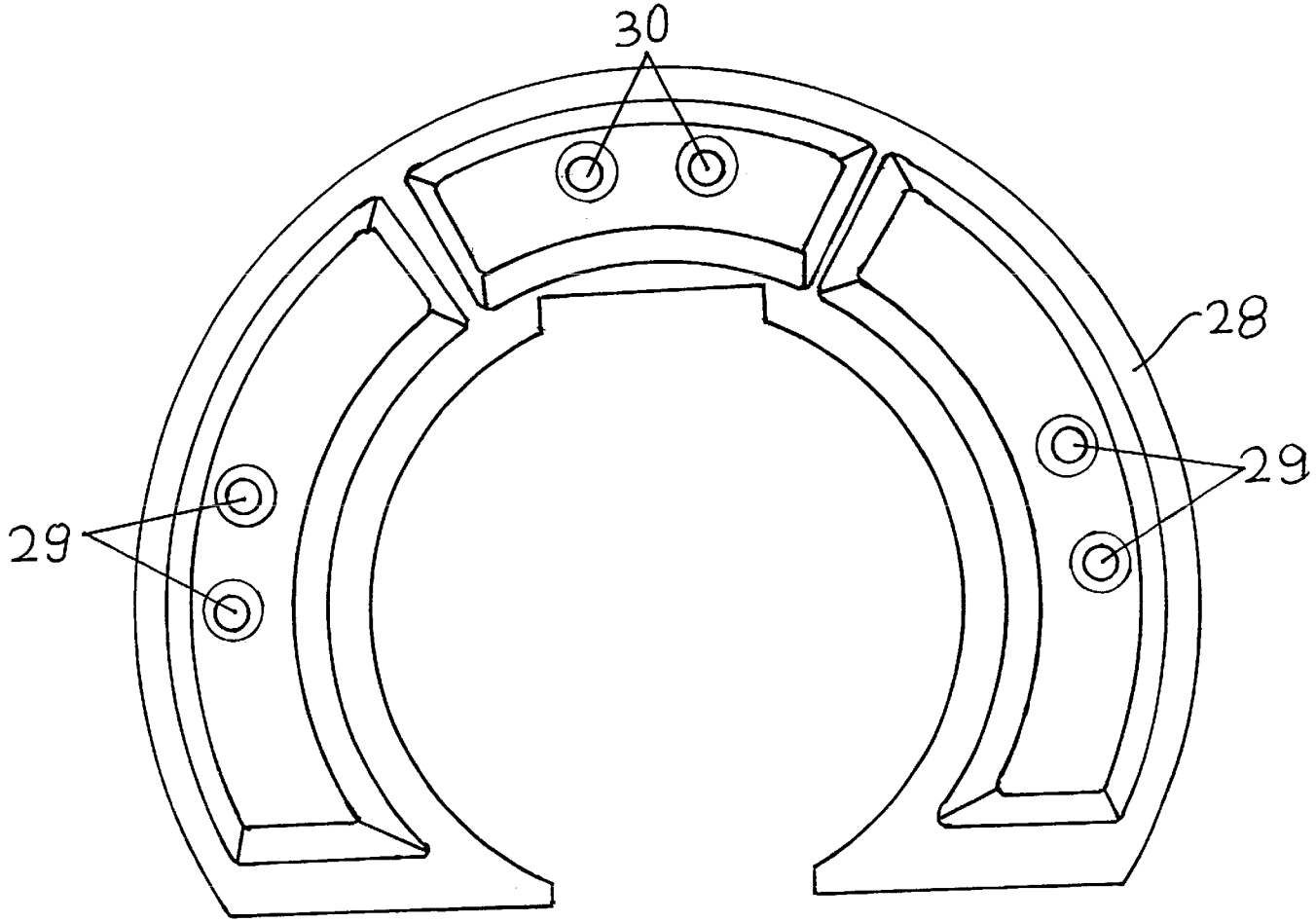
FIG. 6 is a view from below of an annular support inclusive an infra-red rays emitter and reading lamps.

Infra-red emitters 29, which serve as heat sources, are arranged in this supporting part 28. Additionally, reading lamps 30 are present. This supporting part 28 is illustrated separately in FIG. 6. It is to be noted that the infra-red emitters 29 and the reading lamps 30 are located at that side of the dispensing head 15 at which the exit holes 17 is located.

Two laterally projecting supporting arms 31 are hingedly mounted to the housing 7, or supporting column part 1, respectively. These supporting arms 31 carry further infrared emitters 32 which are arranged in such a position that they are directed laterally against the head or the crown of the head, respectively, of the person being treated. When this further infra-red emitters 32 are not in use they may be rotated upward around their pivotal points 33 into a turned aside position.

At the bottom end of the supporting column end of the supporting column part 1 there is located, furthermore, an apparatus 24 for a sterilizing of hair treatment devices, such a brushes, hair curlers, etc.

While there are shown and described presently preferred embodiments of the invention, it is to be distinctly understood that the invention is not limited thereto but may be otherwise variously embodied and practiced within the scope of the following claims.

What is claimed is:

1. Multifunctional apparatus for the treatment of hair of the head of humans, the apparatus comprising a supporting column part and a jib part which ends at a treatment head part, a housing which is mounted to said supporting column part; at least one apparatus for producing hot air; at least one further apparatus for producing steam; the at least one apparatus for producing steam being located inside of said housing; the jib part being hingedly mounted to said housing; the treatment head part including a dispenser head which communicates with said at least one apparatus and said at least one further apparatus; the dispenser head being supported for rotation between first and second end positions and including at a first side a diffusor portion with exit holes for at least one medium supplied from said at least one apparatus and including at a further side disposed opposite of said first side a plurality of pipe stubs which are coupled to dispensing hoses and communicate with at least one of the group consisting of said at least one apparatus and said at least one further apparatus; the dispensing hoses being adapted to be coupled to hair curlers; wherein in the first of the end positions of said dispenser head said exit holes and in the second of the end positions of said dispenser head said pipe stubs communicate with at least one of said apparatuses located inside of said housing, wherein said jib part comprises a receiving container adapted to receive dispensing hoses which are not in use when said dispensing head is in one of the end positions, and includes a through shaped receiving container portion extending in a longitudinal direction of the receiving container, the receiving container portion being pivotally mounted to said housing, and wherein a cover lid portion is pivotally mounted to said receiving container portion and rotatable between an open position and a closed position, the cover lid portion including at a free end a hood part which covers said dispensing head when said cover lid portion is in the closed position.

2. The apparatus of claim 1, wherein said apparatus for producing hot air communicates with said dispensing head by a hot air pipe extending through said jib part.

3. The apparatus of claim 2, wherein said dispensing head is mounted for rotation on said hot air pipe, which hot air pipe includes a lower exit opening located in the area of the dispensing head, which lower exit opening communicates at the one end position of said dispensing head with said exit holes and at the other end position of said dispensing head with said pipe stubs.

4. The apparatus of claim 3, wherein said apparatus for producing steam is connected to a steam pipe which projects within a area of the hot air pipe located inside of said dispensing head between said side and said further side obliquely into the hot air pipe, so that an ejector of which the hot air is the driving medium is formed.

5. The apparatus of claim 4, wherein said apparatus for producing hot air includes a device for feeding the hot air in through the hot air pipe.

6. The apparatus of claim 5, wherein said apparatus for producing steam includes a water tank with a ultrasonic atomizer located in the tank.

7. The apparatus of claim 6, wherein an additional hot air hose is connected to said apparatus for producing hot air at the area of said housing, which additional hot air hose is adapted to be coupled to a hair-curler like aerated hair-brush.

8. The apparatus of claim 7, wherein said dispensing head is surrounded by an annular supporting part which includes infra-red emitters, wherein the infra-red emitters face downwards towards the head of a person being treated with the multifunctional apparatus with the dispensing head in the first position.

9. The apparatus of claim 8, comprising two lateral supporting arms mounted to said supporting column part and having further infra-red emitters, which supporting arms are adapted to be located in an operating position are at both sides of the head of a person of which the hair is treated, so that said further infra-red emitters oriented laterally facing the respective head.

10. The apparatus of claim 8, wherein the annular supporting part includes at least one reading lamp, wherein the at least one reading lamp faces downwards toward the head of a person being treated with the multifunctional apparatus with the dispensing head in the first position.

11. The apparatus of claim 9, wherein said supporting arms are pivotally mounted to said supporting column part for a rotational movement between an operating position and a turned aside position.

12. The apparatus of claim 11, wherein said supporting column part is of a telescopic design so that its length is adjustable, whereby the height position of the treatment head part may be adjusted.

13. The apparatus of claim 12, comprising an apparatus for sterilizing hair treatment devices, which apparatus is mounted to said supporting column part.

14. The apparatus of claim 13, wherein said supporting column part is mounted on a mobile bottom frame.

* * * * *